US008437683B2

(12) United States Patent
Suzuki

(10) Patent No.: US 8,437,683 B2
(45) Date of Patent: May 7, 2013

(54) SHEET FEEDING DEVICE AND IMAGE FORMING APPARATUS

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 487 days.

(21) Appl. No.: 12/700,385

(22) Filed: Feb. 4, 2010

(65) Prior Publication Data

US 2010/0209163 A1 Aug. 19, 2010

(30) Foreign Application Priority Data

Feb. 13, 2009 (JP) ..... 2009-031057

(51) Int. Cl.
*B65H 3/12* (2006.01)

(52) U.S. Cl.
USPC ..... 399/397; 399/393

(58) Field of Classification Search ..... 399/397, 399/393, 388, 389; 271/90, 97, 98, 103; 400/627, 629; *B65H 3/48, 3/12; B41J 13/08*
See application file for complete search history.

(56) References Cited

U.S. PATENT DOCUMENTS

2005/0236764 A1* 10/2005 Saeki et al. ..... 271/293
2007/0231034 A1* 10/2007 Yasui ..... 399/401
2008/0237968 A1* 10/2008 Suzuki ..... 271/98

FOREIGN PATENT DOCUMENTS

JP 2003-165641 AS 6/2003
JP 2004-131291 A 4/2004
JP 2008-239312 A 10/2008

OTHER PUBLICATIONS

Notice of Reasons for Refusal for Japanese Patent Application No. 2009-031057, mailed Jan. 8, 2013, with English translation.

* cited by examiner

*Primary Examiner* — Judy Nguyen
*Assistant Examiner* — Jennifer Simmons
(74) *Attorney, Agent, or Firm* — Cantor Colburn LLP

(57) ABSTRACT

A sheet feeding device including: a sheet feeding tray; a first air blowing section which blows air against a lateral side of the sheet bundle; a second air blowing section which blows air against a leading edge of the sheet bundle; a sheet adsorption conveyance section which conveys sheets one by one; a sheet type information transmission section; a shielding member arranged to open or shield the ventilating path; a shielding state switching section which switches to any one state of opening, partial shielding and overall shielding, wherein in the partial shielding state, less amount of air is allowed to pass than the opening state; a sheet adsorption detecting section; and a control section which controls to switch among the state of opening, partial shielding and overall shielding of the ventilating path, in accordance with the information from the sheet type and the sheet adsorption detection.

12 Claims, 11 Drawing Sheets

SHEET FEEDING DEVICE AND IMAGE FORMING APPARATUS

CROSS REFERENCE TO RELATED APPLICATION

The present application is based on Japanese Patent Application No. 2009-031057 filed with Japanese Patent Office on Feb. 13, 2009, the entire content of which is hereby incorporated by reference.

BACKGROUND OF THE INVENTION

1. Technical Field

The present invention relates to a sheet feeding device that is used for an image forming apparatus such as a copying machine, a printer, a facsimile machine, a printing machine and a multi-functional peripheral, and in particular, to a sheet feeding device wherein a single sheet is separated to be fed out from a sheet bundle through air-blowing, and to an image forming apparatus equipped with the sheet feeding device.

2. Background of the Invention

In recent years, uses for a copying machine and a printer have been expanded, and sheets of various types including coated paper have come to be used. Some of these sheets of various types show strong sticking power between respective sheets when they are stacked as a sheet bundle, whereby, an occasion where it is difficult to surely prevent multiple-sheet feeding tends to be caused, in a sheet feeding device that feeds out sheets one sheet by one sheet with a friction roller.

Therefore, there has been proposed a method wherein an air-blowing outlet is provided on a flank of the stacked sheet bundle in the sheet conveyance direction, and air is blown against plural sheets on the upper part of the stacked sheet bundle from this air-blowing outlet, so that air may pass between the sheets and plural sheets may be separated from the sheet bundle.

The sheet separated in this manner is sent to an image forming section one sheet by one sheet by a sheet-feeding roller, and in the case of image forming apparatuses such as printing machines, some of them employ a conveying method for the uppermost sheet on the stacked sheet bundle by using an adsorption belt, while attracting the sheet through suction. What is popular generally in this method is one having the structure wherein an air-blowing outlet that blows air against a sheet leading edge from the downstream side in the sheet conveyance direction is provided separately, and air is blown against a sheet leading edge from this air-blowing outlet to separate a single sheet only.

However, a sheet having high smoothness like coated paper has a characteristic to stick to each other strongly under the environmental condition of high humidity, and therefore, if a flow of air blown from the side to gaps of sheets is weak, it is impossible to separate sticking sheets from the sheet bundle and to cause the sheets to be lifted.

To solve this problem, air-blowing to lift the sheets may be made to be strong. However, if the air-blowing is made to be strong, there is generated air pressure that lifts up not only the sheet to be stuck on an adsorption belt but also plural sheets from the lower portion to press them against the adsorption belt. When air that lifts up sheets enters the gaps between sheets and plural sheets are lifted up, even if trying to separate and scrape off the useless sheet by blowing air from the front under the aforesaid condition, it is not possible to separate properly because of a collision between the aforesaid air and air to lift up, resulting in a cause for multiple-sheet feeding.

To solve this problem, Unexamined Japanese Patent Application Publication No. 2008-239312, for example, discloses a sheet feeding device wherein, when a sheet is stuck to an adsorption belt, air coming from the side is stopped to blow only air from the front side against the sheet, and thereby, to scrape off sheets other than the sheet that is stuck to the adsorption belt.

If this technology is employed, a collision between air from the front side and air from the flank side is not caused, and sheets other than the sheet that is stuck to the adsorption belt are scraped off properly.

However, even when the sheet feeding device disclosed in Unexamined Japanese Patent Application Publication No. 2008-239312 is used, it is difficult to cope with all sheets having various sheet types and various sizes (including thickness). In particular, in the case of a sheet that is small in size and is thin in thickness, there is a problem that plural sheets fly up to cause multiple-sheet feeding when air from the flank side is stopped and air from the front side is blown. For this problem, the inventors of the present invention found out through experiments that flying up of sheets can be inhibited by blowing air in a small air flow quantity from the flank side without stopping the air flow from the flank side when blowing air from the front side.

However, in the case of a sheet that is large in size and is thin in thickness, there still is a problem that sheets including the second sheet and thereafter are blown up and multiple-sheet feeding and sheet jamming are caused even when an air flow quantity is made to be small, if blowing of air from the side is continued even after the uppermost sheet in a sheet bundle is stuck on the adsorption belt.

An objective of the invention is to solve the aforesaid problems and to provide a sheet feeding device that is free from the problem of multiple-sheet feeding even for sheets having various sizes (including thickness), and has stable sheet conveyance properties.

SUMMARY

The aforesaid objectives of the invention can be attained by the following constructions.

Item 1: A sheet feeding device including:

a sheet feeding tray on which a sheet bundle including a plurality of sheets is stacked;

a first air blowing section which blows air in a perpendicular direction to a sheet conveyance direction against a lateral side of the sheet bundle stacked on the sheet feeding tray;

a second air blowing section which blows air against a leading edge of the sheet bundle in a sheet conveyance direction from a downstream side in the sheet conveyance direction, a sheet adsorption conveyance section which adsorbs by air suction and conveys sheets one by one from an uppermost sheet of the sheet bundle;

a sheet type information transmission section which transmits type information of the sheet to be used;

a shielding member which is arranged to be capable of opening and closing in a ventilating path of the first air blowing section to open or shield the ventilating path;

a shielding state switching section which switches a shielding state of the ventilating path by the shielding member to any one state of opening, partial shielding and overall shielding, wherein in the partial shielding state, less amount of air is allowed to pass than the amount of air in the opening state, and the air is totally shielded in the overall shielding state;

a sheet adsorption detecting section which detects that the uppermost sheet in the sheet bundle has been adsorbed, and transmits detection information to the sheet adsorption conveyance section, and a control section which controls the shielding member and the shielding state switching section to operate and switch among the state of opening, partial shielding and overall shielding of the ventilating path, in accordance with the information from the sheet type information transmission section and the sheet adsorption detecting section.

Item 2: The sheet feeding device of Item 1, further including a sheet ejection detecting section which detects that the sheet adsorbed by the sheet adsorption conveyance section is ejected, and transmits the information of detection, Wherein the control section controls the shielding member and the shielding state switching section to operate and switch among the state of opening, partial shielding and overall shielding of the ventilating path, in accordance with the information from the sheet type information transmission section and one of the information from the sheet adsorption detecting section or the sheet ejection detecting section.

BRIEF DESCRIPTION OF THE DRAWINGS

These and other objects, advantages and features of the invention will become apparent from the following description thereof taken in conjunction with the accompanying drawings in which.

Figure 6A:
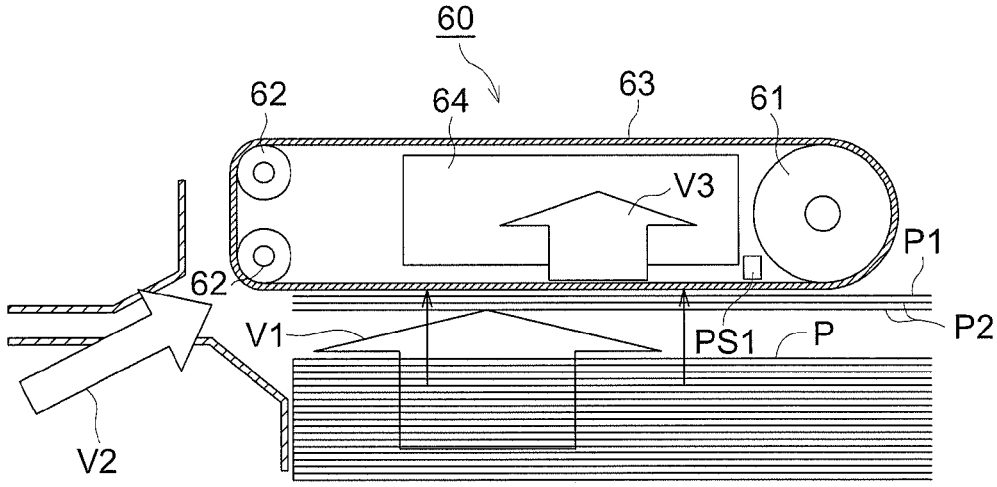
Figure 6B:
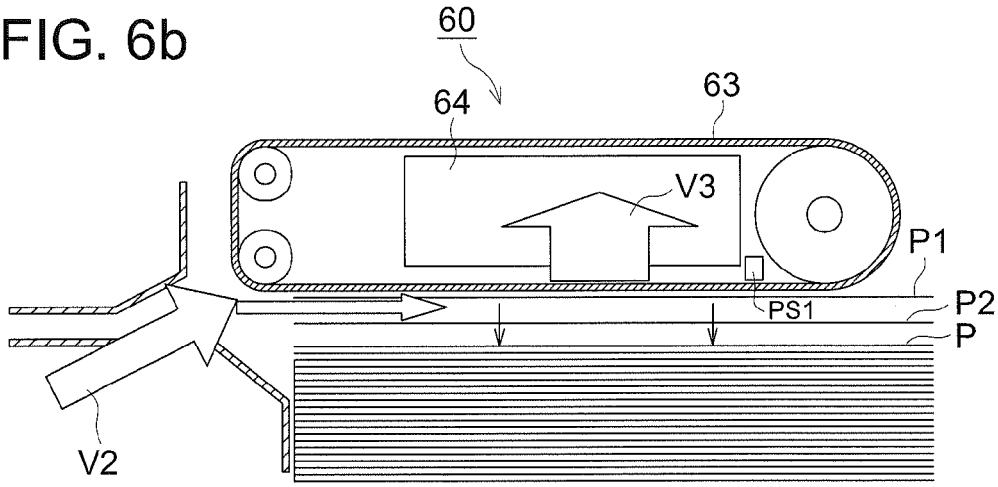
Figure 7A:
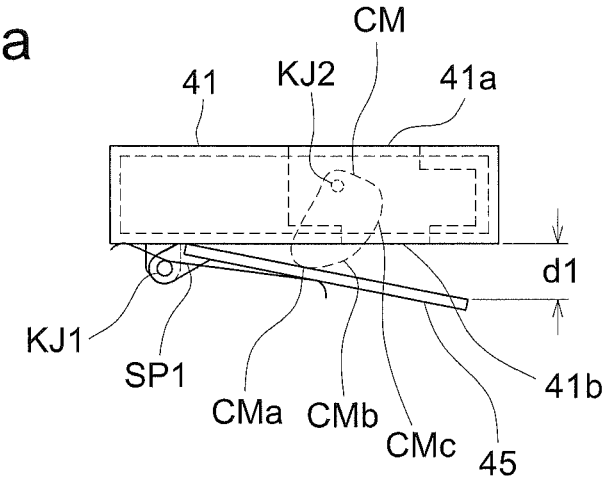
Figure 7B:
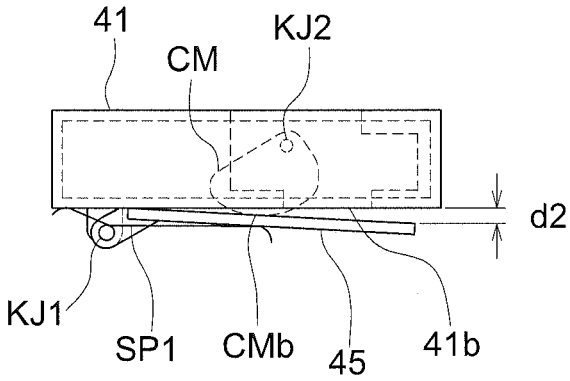
Figure 7C:
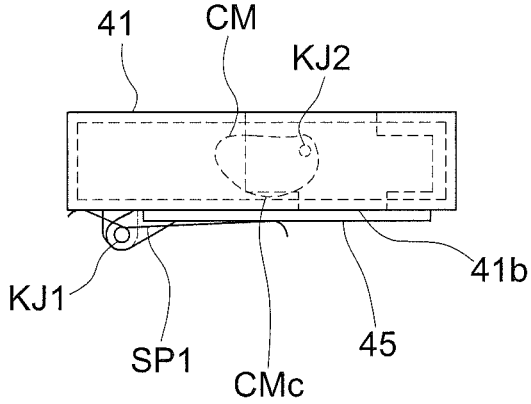
Figure 8A:
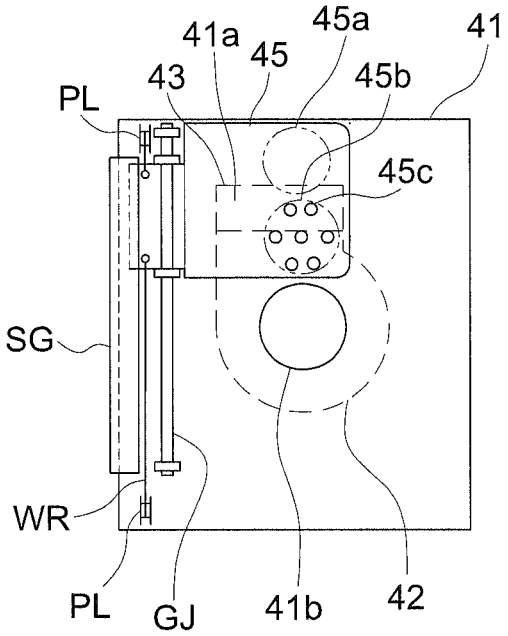
Figure 8B:
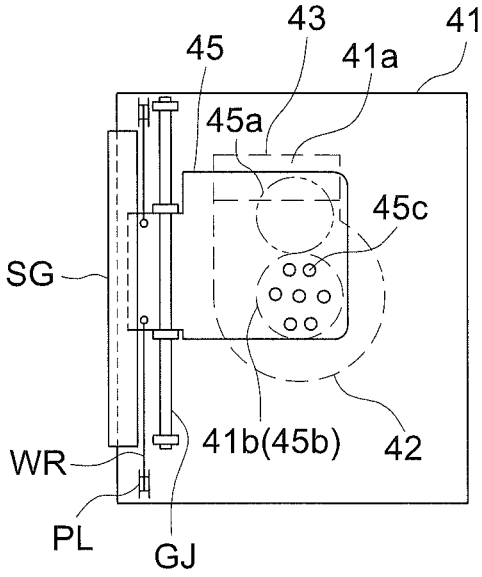
Figure 8C:
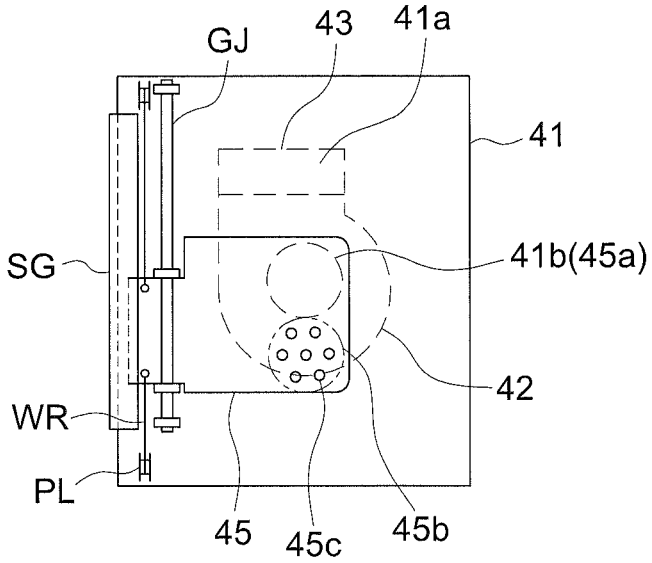
Figure 9A:
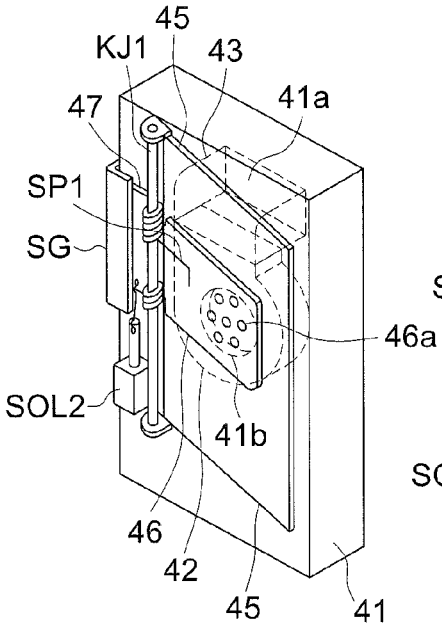
Figure 9B:
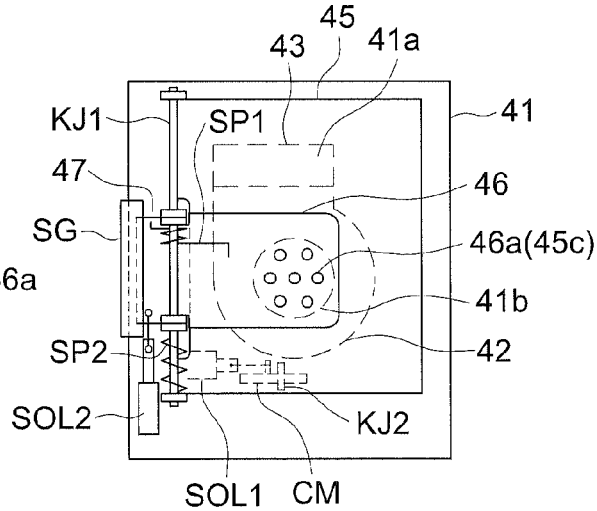
Figure 9C:
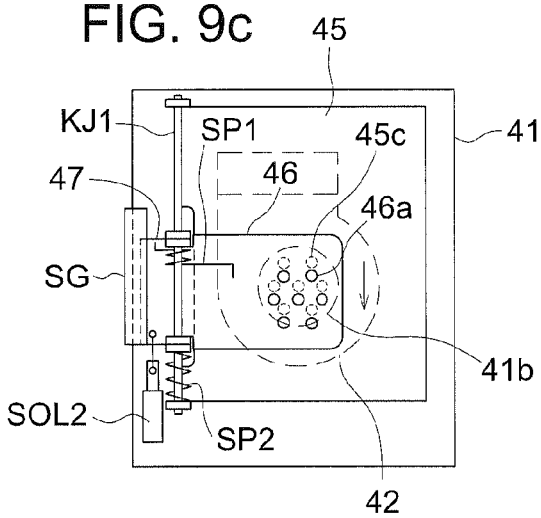

Each of FIGS. 6*a* and 6*b* is a section view showing a sheet adsorption conveyance process by the first air blowing section 40 and the second air blowing section 50;

Each of FIGS. 7*a*-7*c* is a schematic top surface diagram for illustrating the first shielding mechanism employing a shielding member and a shielding state switching section both relating to the invention;

Each of FIGS. 8*a*-8*c* is a schematic front view for illustrating the second shielding mechanism employing a shielding member and a shielding state switching section both relating to the invention;

Each of FIGS. 9*a*-9*c* is a schematic structural view for illustrating the third shielding mechanism employing a shielding member and a shielding state switching section both relating to the invention.

Figure 10:
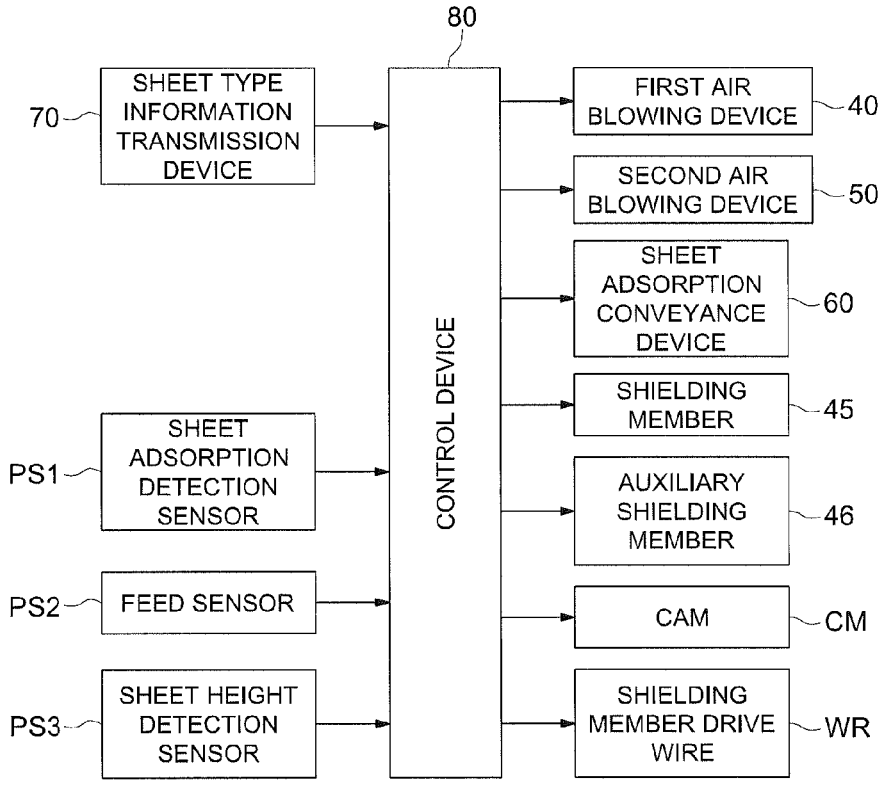
Figure 11:
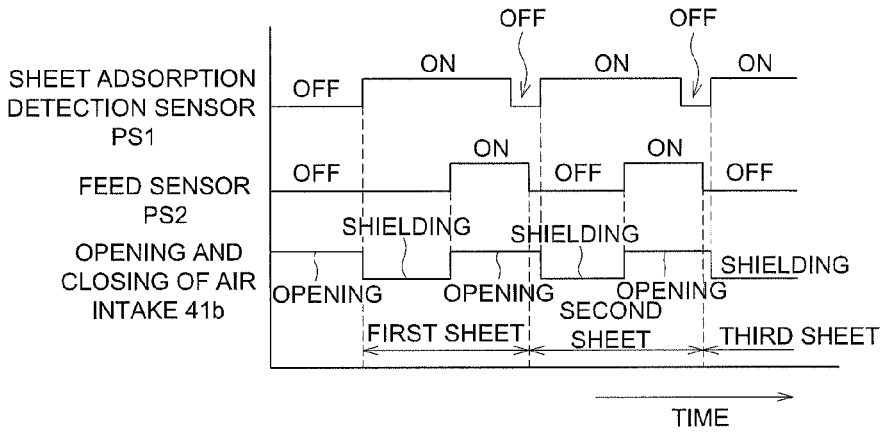
Figure 12:
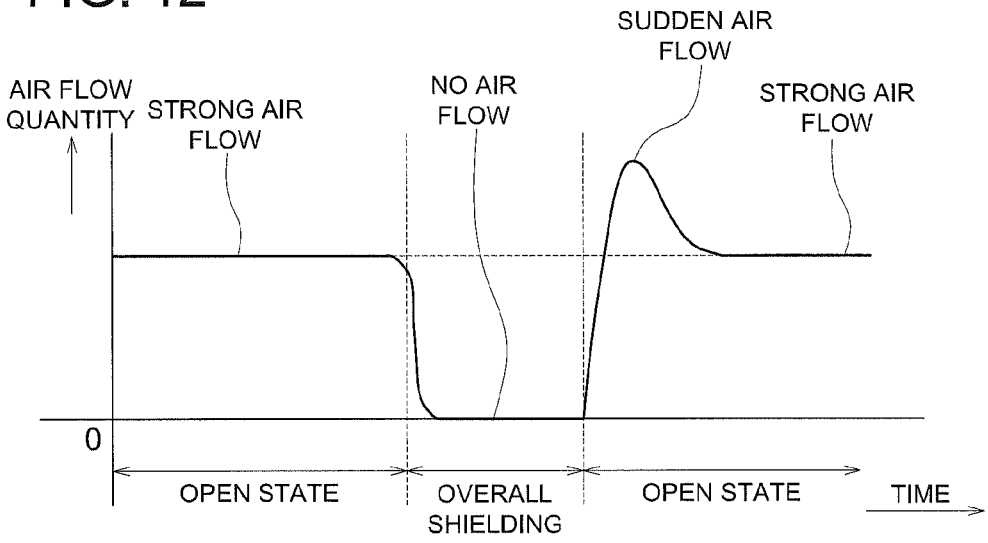
Figure 13:
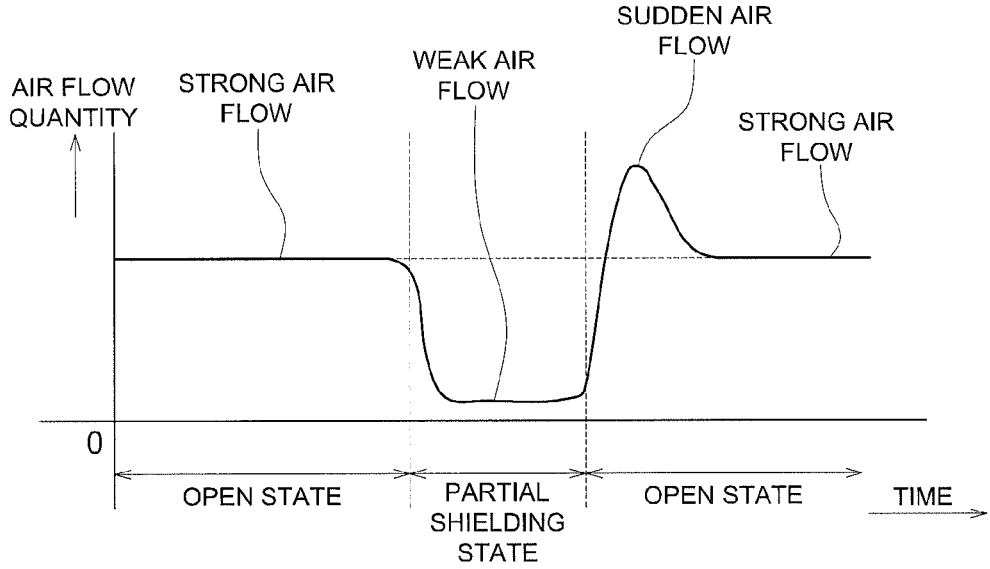

FIG. 10 is a block diagram showing the framework of control for the large capacity sheet feeding device LT;

FIG. 11 is a timing chart showing the control for the large capacity sheet feeding device LT;

FIG. 12 is a graph showing the state of shielding of air intake 41*b* for the sheet wherein a size and a thickness for sheet P are normal; and FIG. 13 is a graph showing the state of shielding of air intake 41*b* for the sheet representing sheet P that is small in size and is thin in thickness.

DETAILED DESCRIPTION OF THE PREFERRED EMBODIMENT

Referring to drawings, there will be explained, as follows, an embodiment of the invention, to which, however, the invention is not limited.

The embodiment of the invention will be explained as follows, referring to the drawings.

[Image Forming Apparatus]

Figure 1:
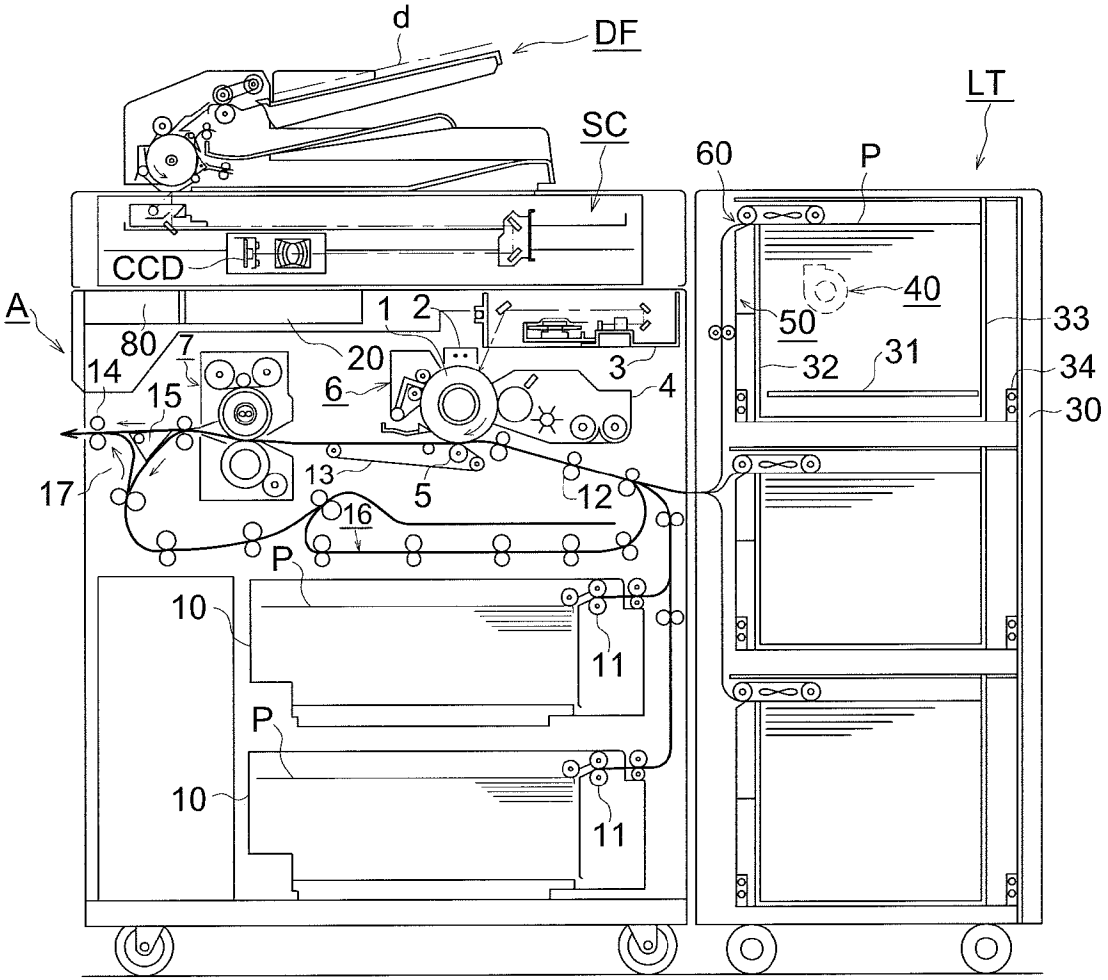
FIG. 1 is an overall structural view of an image forming apparatus relating to the invention.

FIG. 1 is an overall structural view of an image forming apparatus composed of image forming apparatus main body A, image reading device SC, automatic document feeder DF and of large capacity sheet feeding device LT, relating to the invention.

The illustrated image forming apparatus main body A is composed of an image forming section having therein photoconductor (image carrier) 1, charging unit 2, image-wise exposure unit 3, developing unit 4, transfer section 5 and cleaning section 6, fixing unit 7 and of a sheet conveyance system.

The sheet conveyance system is composed of sheet feed cassette 10, first sheet feeding section 11, second sheet feeding section 12, sheet ejection section 14, conveyance path switching section 15, circulation sheet re-feeding section 16 and of reversing sheet ejection section 17.

Document d placed on a document platen of the automatic document feeder DF is conveyed by a sheet feeding section, then, images on one side or both sides of document d are read out by an optical system of the image reading device SC, and are read in by image sensor CCD. Analog signals obtained through photoelectric conversion conducted by image sensor CCD undergo analog processing, A/D conversion, shading correction and image compression processing, in image processing section 20, and then, image signals are sent to image-wise exposure unit 3.

In the image forming section, there are conducted processes such as electrical charging, exposure, developing, transferring, separating and cleaning.

In the image forming section, electric charges (negative charging in the present embodiment) are given to photoconductor 1 by charging unit 2, and an electrostatic latent image is formed by irradiation of a laser beam coming from image-wise exposure unit 3, thus, the electrostatic latent image is visualized by the developing unit 4 to become a toner image (negative electric charge in the present embodiment). After that, sheet P loaded in the sheet feed cassette 10 is conveyed from the first sheet feeding section 11. The sheet P is conveyed after being synchronized with the toner image in the second sheet feed section 12 that is composed of registration roller. After that, the toner image is transferred onto the sheet P in the transfer section 5, and the toner image thus transferred is fixed by the fixing unit 7.

The sheet P subjected to fixing is ejected out of the apparatus by the sheet ejection section 14. On the other hand, toner remaining on the photoconductor 1 after the transfer processing is eliminated by cleaning section 6. Incidentally, in the case of duplex copying, sheet P on which an image has been formed on the first surface is fed into circulation sheet re-feeding section 16 to be reversed, and then, an image is formed again on the second surface in the image forming section, to be ejected out of the apparatus by the sheet ejection section 14. In the case of reversing and ejecting, the sheet P that has branched from a regular sheet ejection path is subjected to switchback in reversing sheet ejection section 17 to be reversed inside out, and then, is ejected out of the apparatus by the sheet ejection section 14.

Control section 80 is arranged inside image forming apparatus main body A to control operations of respective sections including the image forming apparatus main body A, image reading device SC, automatic document feeder DF and large capacity sheet feeding device LT.

The large capacity sheet feeding device LT connected to the image forming apparatus main body A has therein sheet feeding device main body 30, first air blowing section 40, second air blowing section 50 and sheet adsorption conveyance section (sheet feeding section) 60, and it houses large quantities of sheets P to feed them to the image forming apparatus main body A one sheet by one sheet.

The sheet feeding device main body 30 has therein sheet feeding tray 31, leading edge regulating member 32, trailing edge regulating member 33 and guide rail 34. The sheet feeding tray 31 is structured to be in three steps, and each sheet feeding tray 31 is structured to be capable of being drawn from the large capacity sheet feeding device LT by the guide rail 34.

Figure 2:
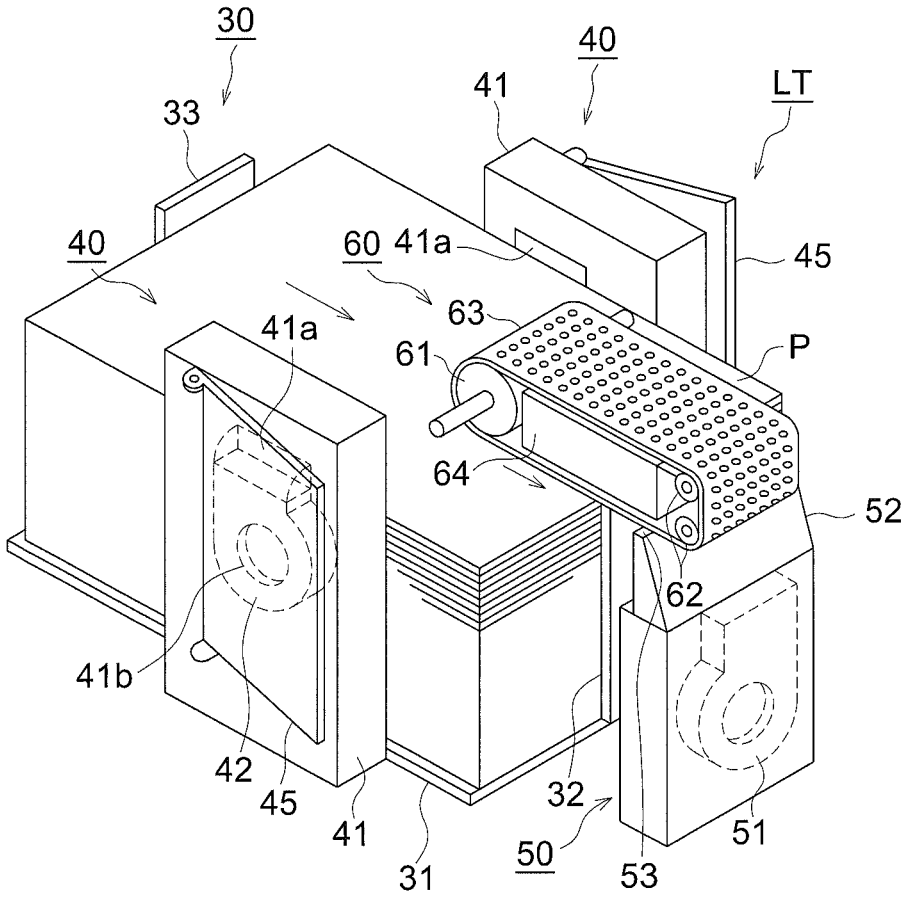
FIG. 2 is a perspective view showing primary portions of large capacity sheet feeding device LT of the invention.
Figure 3:
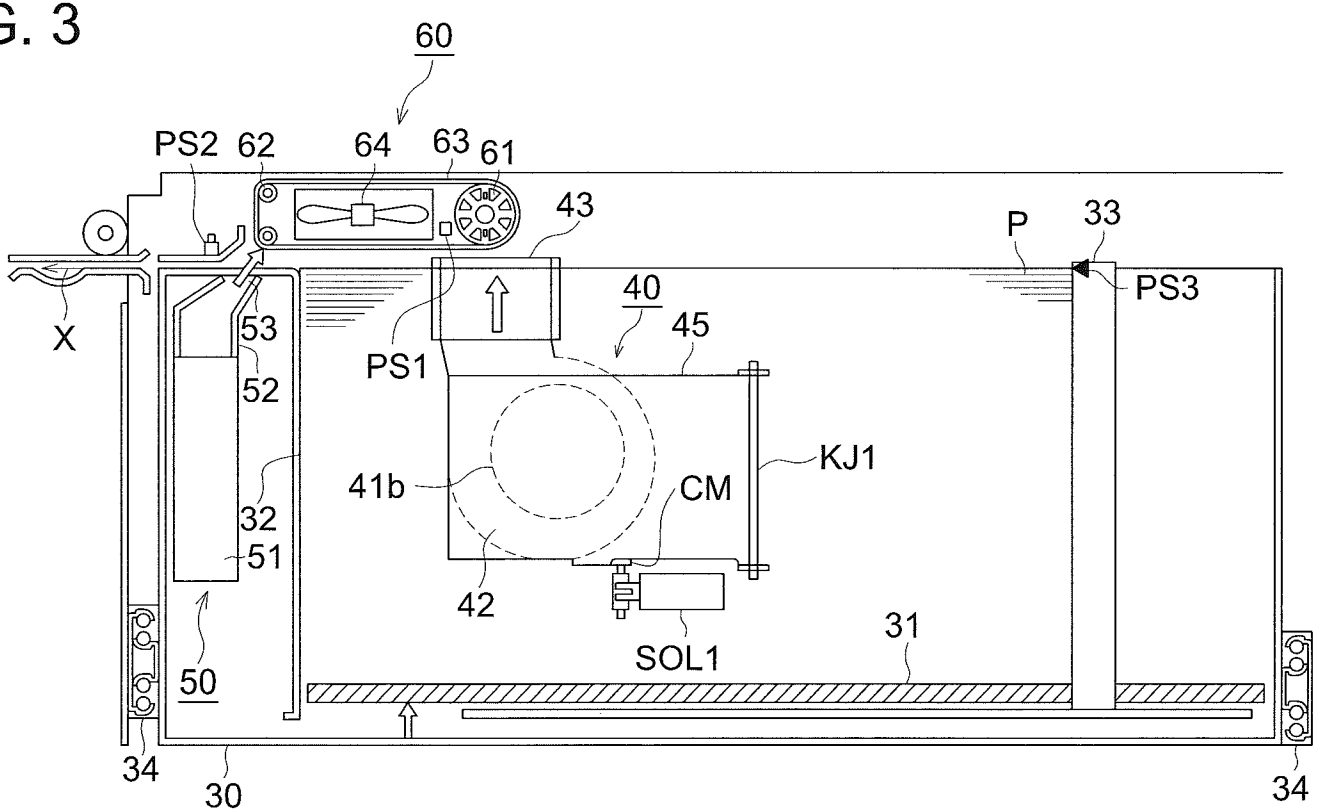
FIG. 3 is a front sectional view of the large capacity sheet feeding device LT relating to the invention.
Figure 4:
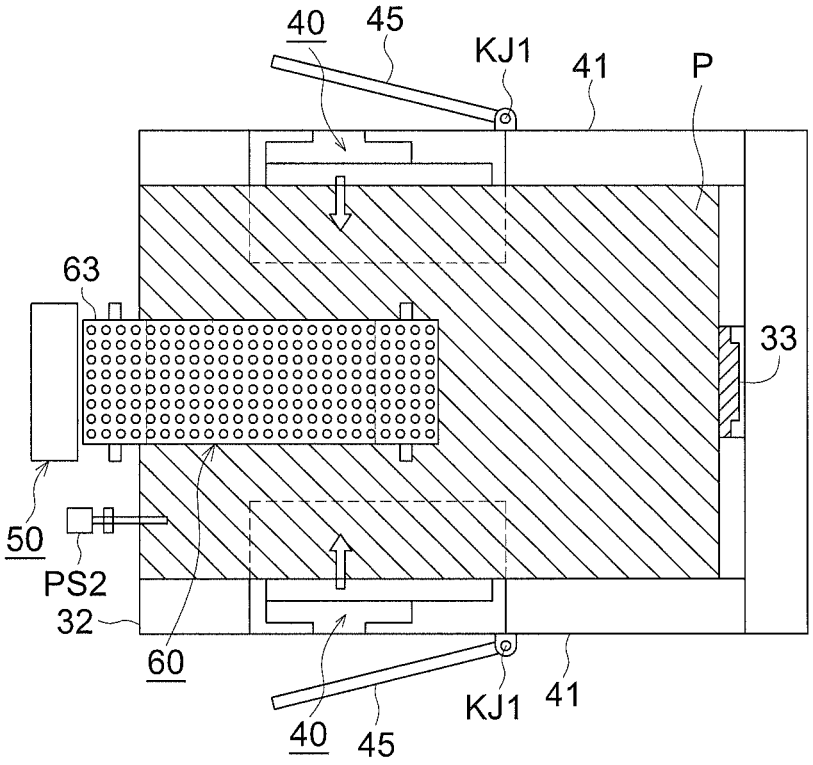
FIG. 4 is a plan view of the large capacity sheet feeding device LT relating to the invention.
Figure 5:
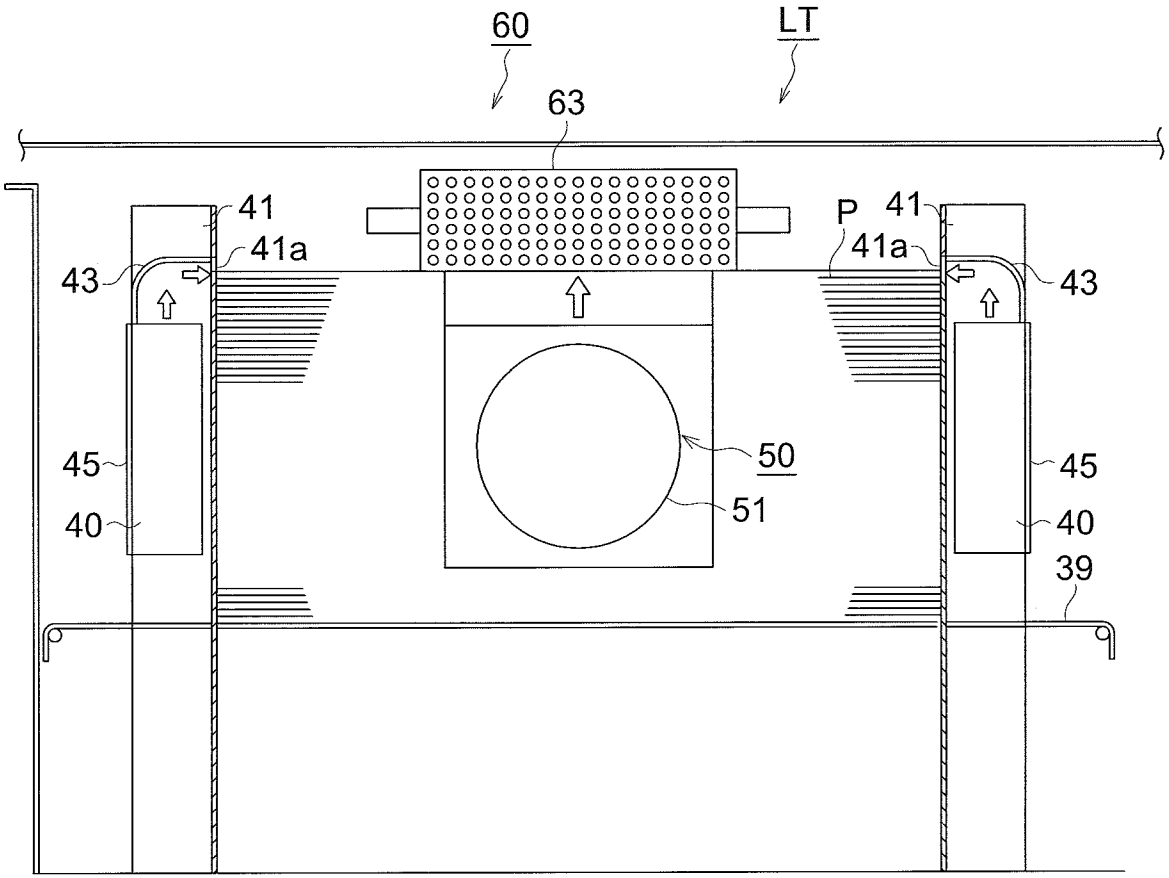
FIG. 5 is a side view of the large capacity sheet feeding device LT relating to the invention.

FIG. 2 is a perspective view showing primary portions of large capacity sheet feeding device LT of the invention, FIG. 3 is a front sectional view of the large capacity sheet feeding device LT, FIG. 4 is a plan view and FIG. 5 is a side view.

In the drawings mentioned above, stacked plural sheets P are placed on the sheet feeding tray 31 as a sheet bundle which is housed by an unillustrated mechanism to be capable of going up and down. Side portion regulating member 41 is arranged to be movable freely in the direction (sheet width direction in the present example) that intersects the sheet conveyance direction for sheet P, and it regulates positions of both sides of the sheet bundle by pressing both sides of the sheet bundle lightly, for the sheet bundle. The leading edge regulating member 32 regulates a position of the leading edge of sheet P in the sheet conveyance direction, while, the trailing edge regulating member 33 is arranged to be movable freely in the sheet conveyance direction, and it regulates a position of the trailing edge of sheet P in the sheet conveyance direction.

Further, as shown in FIG. 3, sheet height detection sensor PS3 that detects a height of sheet P in the vicinity of the uppermost portion is arranged on the trailing edge regulating member 33.

For keeping the optimum height for air blowing and for adsorption of sheet P, for a sheet bundle stacked on the sheet feeding tray 31, the control section 80 drives an unillustrated motor for rise and fall based on the detection by the sheet height detection sensor PS3 shown in FIG. 11, to cause the sheet feeding tray 31 to rise and fall.

As shown in FIG. 3, sheet adsorption conveyance section 60 is arranged in the vicinity of the leading edge of sheet P in the sheet conveyance direction. The sheet adsorption conveyance section 60 has adsorption belt 63 that is trained about large roller 61 that is connected with an unillustrated driving source and about two small rollers 62 to rotate. The adsorption belt 63 has thereon a large number of small through holes. Inside the adsorption belt 63, there is arranged suction section 64 that sucks air, and it conveys sheets P while sucking a single sheet through the adsorption belt 63.

When the adsorption belt 63 is rotated while sucking sheet P on the uppermost layer of the sheet bundle stacked on the sheet feeding tray 31, the sheet P is conveyed in the direction of illustrated arrow X, and is fed into image forming apparatus main body A.

Sheet adsorption detecting sensor PS1 representing a sheet adsorption detecting section relating to the invention is arranged in the vicinity of an adsorption surface of the adsorption belt 63, and it detects that the upper surface of sheet P on the uppermost layer of the sheet bundle has been stuck, and transmits detection signals as sheet detection information.

Feed sensor PS2 serving as a sheet ejection detecting section relating to the invention is arranged in the vicinity of the adsorption belt 63 that is at the downstream side in the sheet conveyance direction of the sheet feeding tray 31, and it detects a passage of sheet P ejected from sheet adsorption conveyance section 60, to transmit signals serving as sheet detection information.

In the vicinity of the adsorption belt 63 that is at the downstream side in the sheet conveyance direction of the sheet feeding tray 31, second air blowing section 50 is fixed on sheet feeding device main body 30. The second air blowing section 50 is composed of an electric fan and others, and it blows air against the leading edge of the sheet bundle in the sheet conveyance direction from the downstream side in the sheet conveyance direction. Meanwhile, the second air blowing section 50 may also be in the construction wherein the second air blowing section 50 is attached on the sheet feeding device main body 30, and it blows air against the leading edge of the sheet bundle through a duct.

Electric fan 51 of the second air blowing section 50 is installed with its air-blowing outlet 53 facing upward. The air that is blown upward is changed in terms of direction by guide plate 52 to be blown out from the air-blowing outlet 53 upward obliquely, thus, air is blown against the vicinity of the adsorption belt 63 of sheet adsorption conveyance section 60.

A method of driving the second air blowing section 50 varies depending on types of sheet P. Namely, in the case of sheets including an OHP film, a tracing paper, a coated paper whose surface is smooth, a sheet subjected to processing of perforations and creasing, and a sheet on which powder is coated after offset printing, air is blown in a gap between sheets to ensure sheet separation.

As shown in FIG. 2 and FIG. 5, the first air blowing section 40 is arranged on each of both sides of sheet feeding tray 31, and it blows air against the upper portion of the lateral side of a sheet bundle that is stacked inside the sheet feeding tray 31, in the direction perpendicular to the sheet conveyance direction for sheet P. The first air blowing section 40 has electric fan 42 that blows air against an upper portion on the side of a sheet bundle from air-blowing outlets 41*a* on both sides in the lateral direction perpendicular to the sheet conveyance direction for sheet P, and has air-blowing guide 43.

The first air blowing section 40 is arranged inside the side portion regulating member 41. The electric fan 42 is installed with its air-blowing outlet that faces upward. The air that is blown upward is changed in terms of direction by air-blowing guide 43 by 90 degrees, and is blown out of air-blowing outlet 41*a* in the horizontal direction. The air-blowing outlet 41*a* is opened in the vicinity of the upper end of the side surface where side portion regulating member 41 comes in contact with sheet P. A width of the air-blowing outlet 41*a* is almost the same as a width of a nozzle of the first air blowing section 40. Desirable positional relationship of sheet P on the uppermost layer is at almost the center between the upper end and the lower end of the air-blowing outlet 41*a*. Since the first air blowing section 40 is installed inside the side portion regulating member 41, the first air blowing section 40 can also be moved together by moving the side portion regulating member 41, even when a size of sheet P is changed. Meanwhile, though the first air blowing section 40 is provided on each of both sides of sheet P and the air-blowing outlet 41*a* are provided on each of both sides of sheet P in the present example, each of them can also be provided only on one side of sheet P.

When the first air blowing section 40 is driven, air is ejected from the air-blowing outlet 41*a*, and air is blown against several sheets positioned at an upper portion of the stacked sheets P. The air is blown from the end portion of sheets P on one side to the end portion on the other side through a gap between sheets. The air passes through gaps between sheets from the end portion on one side of sheet P and is blown against an end portion on the other side of sheet P. Owing to this, several sheets in the upper portion of sheets P are separated into individual sheets. The sheet adsorption conveyance section 60 takes out only the uppermost sheet from these separated sheets P, and sends it surely to the downstream side.

As shown in FIG. 2 and FIG. 3, air intake 41*b* of the first air blowing section 40 is an opening section that is shielded by shielding member 45 and is opened and closed freely. Namely, the shielding member 45 of a shielding section is supported by rotation shaft KJ1, and is opened and closed by solenoid SOL1 and cam CM. Control section 80 controls the shielding member 45 to be opened and closed freely and controls an air flow quantity for air blowing by the first air blowing section 40 to be switched.

FIGS. 6*a* and 6*b* are sectional views showing a sheet adsorption conveyance process by the first air blowing section 40 and the second air blowing section 50.

FIG. 6*a* shows a sheet adsorption process. Sheets P in a small quantity in the upper layer of a sheet bundle stacked on sheet feeding tray 31 are lifted up defying their empty weight by the first air blowing V1 (illustrated outlined arrow) blown up by the first air blowing section 40, and are stuck by inspiration V3 (illustrated outlined arrow) by negative pressure of adsorption belt 63. The second air blow V2 (illustrated outlined arrow) blown up by the second air blowing section 50 blows against the vicinity of the front bottom portion of the adsorption belt 63. Sheet adsorption detecting sensor PS1 is arranged on an inner side of the adsorption belt 63, and it detects sheet P sticking to the adsorption belt 63 through a hole having a small diameter formed on the adsorption belt 63. The sheet adsorption detecting sensor PS1 that has detected adsorption of sheet P transmits the detection signals to control section 80.

FIG. 6*b* shows a process of sheet separation. When the sheet adsorption detecting sensor PS1 detects sheet P sticking to the adsorption belt 63, if the shielding member 45 shields an air intake of the first air blowing section 40 to stop the air blowing or to restrict the air blowing, the air blow by the second air blowing section 50 passes through a space between sheet P1 on the uppermost layer and a sheet of sheet P2 that is below the sheet P1. The sheet P1 on the uppermost layer is stuck by intake air V3 of the sheet adsorption conveyance section 60, and is separated from sheet P of the sheet bundle excluding the sheet P1 on the uppermost layer. Sheet P2 that is below the sheet P1 on the uppermost layer thus separated descends with its own weight in the direction of an arrow, to be received on sheet P.

When air blowing of the first air blowing section 40 and air blowing of the second air blowing section 50 are repeated in the aforesaid way, floating of several sheets P2 on the upper portion of the sheet bundle is spread on the most part of the entire surface of the air-blowing outlets 41*a* and 53, and respective gaps between sheets become identical roughly in terms of a space. Thus, air passes through this gap. Owing to this, separation of sheet P1 is improved, to make sheet P1 to be fed out easily. Thus, the foregoing solves the problems that floating of sheet P1 grows excessively great to damage sheets, and plural sheets floating together without being separated to make the sheet separation to be impossible.

After the separation of sheet P1 from sheet P2 comes to an end, an unillustrated drive section of the sheet adsorption conveyance section 60 starts its driving, and single sheet P1 sticking to the adsorption belt 63 is conveyed.

FIG. 7 is a schematic top surface diagram for illustrating the first shielding mechanism employing a shielding member and a shielding state switching section both relating to the invention. FIG. 7*a* shows an occasion where shielding member 45 is in the state of opening, FIG. 7*b* shows an occasion where shielding member 45 is in the state of partial shielding and FIG. 7*c* shows an occasion where shielding member 45 is in the state of overall shielding.

In FIG. 7, the shielding member 45 is arranged on the surface (surface with no reference symbol on which air intake 41*b* is formed) that is opposite to a sheet side regulating surface (surface with no reference symbol on which air-blowing outlet 41*a* is formed) of the side portion regulating member 41. The shielding member 45 is supported to be rotatable freely on rotation shaft KJ1 that is held on rotation shaft holding section (having no reference symbol) that is formed on the side portion regulating member 41, and it opens and closes the air intake 41*b*. Pressing spring SP1 is fixed on the rotation shaft KJ1, and it urges the shielding member 45 in the direction to shield the air intake 41*b* serving as a ventilating path.

Cam CM serving as a stopper member representing a shielding state switching section relating to the invention is arranged inside the side portion regulating member 41, and it is held to be rotatable freely with rotation shaft KJ2 combined integrally that serves as a center of rotation. On the cam CM, there are formed first contact portion CMa located at the position to be farthest from rotation shaft KJ2, non-contact portion CMc located at the position close to the rotation shaft KJ2 and second contact portion CMb located at the position between the first contact portion CMa and the non-contact portion CMc. The rotation shaft KJ2 is connected with an unillustrated motor or the like, and is established so that shielding member 45 may stop at the position where the shielding member 45 touches the first contact portion CMa of cam CM or the second contact portion CMb, or the position where the shielding member 45 faces the non-contact portion CMc. As a motor to be connected with the rotation shaft KJ2, there is used a servo-motor or a stepping motor which is controlled to stop at the aforesaid position.

In FIG. 7*a*, cam CM is at the position where the shielding member 45 comes in contact with the first contact portion CMa of cam CM to stop, which makes air intake 41*b* to be in the state of opening. A space between the tip of the shielding member 45 and a surface on which the air intake 41*b* of the side portion regulating member 41, in this case, is represented by d1. In FIG. 1*b*, cam CM is at the position where the shielding member 45 comes in contact with the second contact portion CMb of cam CM to stop, which makes air intake 41*b* to be in the state of partial shielding. When the air intake 41*b* is in the state of partial shielding, an air flow quantity for air passing through the air intake 41*b* becomes smaller than that in the case of opening. A space between the tip of the shielding member 45 and a surface on which the air intake 41*b* of the side portion regulating member 41 is disposed, in this case, is represented by d2. Values of the space d1 and the space d2 can be changed by a form of cam CM and by an angle of rotation, and they can be established to be appropriate values which make it possible to obtain appropriate air flow quantity based on experiments, depending on types and sizes (including thickness) of sheets to be used. In FIG. 7*c*, cam CM is at the position where shielding member 45 stops to face non-contact portion CMc of cam CM, to make the air intake 41*b* to be in the state of overall shielding, thus, air passage is intercepted.

Though the rotatable cam CM serves as a stopper member in the present embodiment, the stopper member may also be a stopper member that is moved by a motor or the like in the direction perpendicular to air intake 41*b*.

By using a sheet feeding device having the structure relating to the present embodiment, it is possible to obtain, with a simple construction, an appropriate quantity of air blow corresponding to a sheet size, and to establish a set point of a air blow quantity easily to an optional value.

FIG. 8 is a schematic front view for illustrating the second shielding mechanism employing a shielding member and a shielding state switching section both relating to the invention. FIG. 8*a* shows an occasion wherein the shielding member 45 is in the state of opening, FIG. 8*b* shows an occasion wherein the shielding member 45 is in the state of partial shielding and FIG. 8*c* shows an occasion wherein the shielding member 45 is in the state of overall shielding.

In FIG. 8, the shielding member 45 is arranged on the surface on which the air intake 41*b* of the side portion regulating member 41 is formed, and on the shielding member 45, there are formed shielding section 45*a* and partial shielding section 45*b*. The shielding member 45 is held by guide shaft GJ to be capable of sliding freely, and the guide shaft GJ is held by a guide shaft holding section (having no reference symbol) that is formed on the side portion regulating member 41. On the partial shielding section 45*b*, there is formed vent hole 45*c*. Shielding member drive wire WR representing a shielding state switching section relating to the invention is trained about two pulleys PL, and its both ends are fixed on a mounting section (having no reference symbol) of the shielding member 45. Either one of the two pulleys PL is connected to an unillustrated motor. As the motor, a servo-motor capable of being controlled in terms of rotation, or a stepping motor is used, similarly to the first shielding mechanism. Due to the rotation of the motor to be controlled in terms of rotation, the shielding member drive wire WR is moved through pulley PL, whereby, the shielding member 45 is moved to open or close air intake 41*b*. The symbol SG represents a sliding guide member for causing the shielding member 45 to slide. A size and the number of vent holes 45*c* are set to values with which an appropriate air flow quantity based on experiments are obtained depending on a type and a size (including a thickness) of the sheet to be used. Further, by making a stop position of shielding member 45 in the state of partial shielding to be a position of the middle between FIG. 8*a* and FIG. 8*b*, or a position of the middle between FIG. 8*b* and FIG. 8*c*, it is possible to create an optional air flow quantity corresponding to a type and a size (including a thickness) of the sheet to be used.

In FIG. 8*a*, the shielding member 45 is at the position where air intake 41*b* of the side portion regulating member 41 is left open. In FIG. 8*b*, the shielding member 45 is at the position where the partial shielding section 45*b* shields the air intake 41*b*, and the partial shielding section 45*b* equipped with vent hole 45*c* causes air intake 41*b* to be in the state of partial shielding. When the air intake 41*b* is in the state of partial shielding, an air flow quantity of air passing through air intake 41*b* becomes smaller than that in the case of opening. In FIG. 8*c*, the shielding member 45 is at the position where air intake 41*b* is shielded by shielding section 45*a*, and the shielding member 45 causes the air intake 41*b* to be in the state of overall shielding.

Incidentally, though the construction where the shielding member moves linearly is employed in the present embodiment, it is also possible to employ the construction wherein a shielding member having a shielding section and a partial shielding section rotates about a rotation axis, and to employ the construction wherein a shielding member having a shielding section, a partial shielding section and an opening section rotates.

In the present embodiment, a air flow quantity can be changed accurately by a simple structure, because a tolerance of dispersion for the stop position of the sliding shielding member 45 is broad.

FIG. 9 is a schematic structural view for illustrating the third shielding mechanism employing a shielding member and a shielding state switching section both relating to the invention. FIG. 9*a* shows an occasion wherein air intake 41*b* is in the state of opening. FIG. 9*b* shows an occasion wherein auxiliary shielding member 46 is at the first position and air intake 41*b* is in the state of partial shielding, and FIG. 9*c* shows an occasion wherein auxiliary shielding member 46 is at the second position and air intake 41*b* is in the state of overall shielding.

In FIG. 9, the shielding member 45 is arranged on the surface on which the air intake 41*b* of the side portion regulating member 41 is formed. The shielding member 45 is equipped with vent hole 45*c* representing the first partial opening section relating to the invention, and it is held to be rotatable freely on rotation shaft KJ1 fixed on rotation shaft holding section (having no reference symbol) of the side portion regulating member 41, to open or close the air intake 41*b*. In the present embodiment, the vent hole 45*c* is composed of plural small holes. The auxiliary shielding member 46 is equipped with vent hole 46*a* representing the second partial opening section relating to the invention that is composed of plural small holes at the position corresponding to vent hole 45*c* of shielding member 45, and it is held by rotation shaft KJ1 to be capable of sliding and rotating freely, to be pressed by pressing spring SP1 against shielding member 45. The pressing spring SP1 is held on rotation shaft KJ1, and it presses shielding member 45 against the surface on which air intake 41*b* of the side portion regulating member 41 is formed through auxiliary shielding member 46.

In the present embodiment, a shielding state switching section is composed of cam CM and auxiliary shielding member 46. Operations of opening and closing shielding member 45 are carried out by operations of rotation about the rotation center by rotation shaft KJ2 of cam CM arranged inside the side portion regulating member 41, and cam CM is operated by solenoid SOL1.

The auxiliary shielding member 46 is held to be capable of rotating freely on rotation shaft KJ1 and is held to be capable of sliding freely on rotation shaft KJ1, similarly to the shielding member 45. The pressing spring SP1 is fixed on rotation shaft KJ1, and it presses auxiliary shielding member 46 against the shielding member 45, and urges the shielding member 45 in the direction for shielding the air intake 41*b* representing a ventilating path. Further, the auxiliary shielding member 46 is connected to solenoid SOL2 through connection plate 47 to be moved, by on-off of the solenoid SOL2, to any one of the first position where vent hole 45*c* and vent hole 46*a* agree with each other in terms of a phase, and the second position where the phases are deviated from each other. The connection plate 47 is engaged with the auxiliary shielding member 46 to be held on rotation shaft KJ1 to be slidable freely, and is connected to solenoid SOL2 to cause the auxiliary shielding member 46 to slide through on-off of the solenoid SOL2. Symbol SG represents a sliding guide that guides the sliding connection plate 47, while, symbol SP2 represents a returning spring that returns the auxiliary shielding member 46 to the first position from the second position through the connection plate 47 in the case of off of the solenoid SOL2. A size and the number of vent holes 45*c* and 46*a* are set to values with which an appropriate air flow quantity based on experiments are obtained depending on a type and a size (including a thickness) of the sheet to be used. Further, in the partial shielding state shown in FIG. 9*b*, it is possible to set to an optional air flow quantity, by deviating slightly the agreed phases for the vent hole 45*c* and vent hole 46*a*.

In FIG. 9*a*, when solenoid SOL1 is turned on, an unillustrated contact portion of cam CM raises shielding member 45 opposing pressing spring SP1, to make air intake 41*b* representing a ventilation path to be in the state of opening. When the solenoid SOL1 is turned off, the contact portion of cam CM is lowered by an unillustrated spring member, and the non-contact portion (unillustrated) of the cam CM is at the position to face the shielding member, the shielding member 45 is urged by pressing spring SP1 to come in contact with the air intake 41*b* representing a ventilation path (see FIGS. 9*b* and 9*c*). When the auxiliary shielding member 46 is at the first position shown in FIG. 9*b*, vent hole 46*a* and vent hole 45*c* agree with each other in terms of a position to cause air intake 41*b* to be in the state of partial shielding. When the air intake 41*b* is in the state of partial shielding, an air flow quantity for air passing through the air intake 41*b* becomes an air flow quantity which is smaller than that in the case of the state of opening. When the auxiliary shielding member 46 is at the second position shown in FIG. 9*c*, vent hole 46*a* and vent hole 45*c* are deviated from each other in terms of a position, to cause the air intake 41*b* to be in the state of overall shielding.

Incidentally, though there is employed the construction wherein the auxiliary shielding member moves linearly in the present embodiment, it is also possible to employ a construction wherein an auxiliary shielding member having a shielding section and a partial shielding section rotates about a rotation shaft.

In the present embodiment, an air flow quantity immediately after opening can be made to be large, because an air flow quantity can be changed with an accurate value in the simple structure, an amount of movement for each of shielding member 45 and auxiliary shielding member 46 can be made small, and a period of time from shielding to opening can be made short.

FIG. 10 is a block diagram showing the framework of control for large capacity sheet feeding device LT, and FIG. 11 is a timing chart showing the control for the large capacity sheet feeding device LT.

In FIG. 10, control section 80 receives information transmitted from sheet type information transmission section 70, sheet adsorption detecting sensor PS1, feed sensor PS2, and from sheet height detection sensor PS3. Based on information thus received, the control section 80 controls operations for the first air blowing section 40, the second air blowing section 50, sheet adsorption conveyance section 60, shielding member 45, auxiliary shielding member 46 and cam CM.

The sheet type information transmission section 70 relating to the invention is composed of an unillustrated operation section that inputs a size (including a thickness) of sheet P in advance, or of an unillustrated sheet size detecting sensor arranged inside large capacity sheet feeding device LT that detects information of longitudinal and lateral sizes of sheet P and transmits the information.

Further, although the sheet type information of sheets (sheet type information) coming from sheet type information transmission section 70 is made to be a sheet size (including a thickness), in the embodiment, information about coated paper, glossy paper or OHP film may also be made to be type information of sheets. Namely, it is a configuration where an optimum air flow quantity for the aforesaid sheets are inputted in the memory of control section 80 as a program in advance, and the air flow quantity is changed in accordance with a type of the sheet to be used.

Next, opening and closing operation timing of air intake 41*b* representing a ventilation path relating to the invention will be explained, referring to FIG. 11.

In FIG. 11, control section 80 causes electric fan 42 for the first air blowing section 40 to operate with signals for the start of image forming coming from an unillustrated operation section to blow air against the side of the upper layer of a sheet bundle on sheet feeding tray 31 from air intake 41*b* that is in the state of opening, so that the sheet P may be lifted up. When the first sheet P is stuck to adsorption belt 63, sheet adsorption detecting sensor PS1 (see FIG. 3) detects it, and the air intake 41*b* is shielded (partial shielding or overall shielding), thus, sheets P including the second sheet and thereafter are separated by air from air-blowing outlet 53 of the second air blowing section 50 to fall. Then, the first sheet P is fed by the start of operation of the adsorption belt 63, and feed sensor PS2 detects the first sheet P, and the air intake 41*b* is opened again to lift up sheets P including the second sheet and thereafter. When the number of sheets for image forming is plural, the second sheet P is stuck to the adsorption belt 63 of sheet adsorption conveyance section 60, and the aforesaid processes are repeated.

Incidentally, though the shielding time of air intake 41*b* does not need to be exactly the same as the aforesaid timing, if it is limited to a moment of the start of feeding out of sheet P, a shielding time period becomes to be extremely short, sufficient effects for separation of sheet P cannot be obtained. Further, if the air intake 41*b* is on the state of continuous shielding when the sheet adsorption detecting sensor PS1 detects adsorption of sheet P, the sheet P is not stuck to adsorption belt 63 due to insufficient raising of the sheet p, and there is sometimes an occurrence of a problem of sheet feeding troubles. Namely, a problem of the sheet feeding troubles comes into existence, when a period of time for shielding is too long, and it is too short. As the best timing, the air intake 41*b* is closed before the start of sheet feeding, namely, when the sheet adsorption detecting sensor PS1 is in the state of on and when the feed sensor PS2 is in the state of off. In the case of sheet feeding, when the feed sensor PS2 is in the state of on, the air intake 41*b* is opened. The second sheet P2 is ejected, and the sheet adsorption detecting sensor PS1 is switched from the state of on to the state of off, then, the feed sensor PS2 is made to be in the state of off, and after a lapse of the designated time, the sheet adsorption detecting sensor PS1 is turned on again by the third sheet P3, thus, the air intake 41*b* is closed.

Based on experiments wherein sheet feeding devices equipped with the first-third shielding mechanisms are used, the inventors of the invention have confirmed that faborable sheet feeding can be practiced by changing an air flow quantity of air from the first air blowing section 40 that blows air against the side portion of sheets P, when a size (including a thickness) of sheet P is changed.

For example, in the case where sheet P is in a small size (for example, a sheet smaller than 35) and is thin (for example, a sheet with 45 kg or less), if the air intake 41*b* is made to be in the state of overall shielding after the first sheet P1 is stuck to adsorption belt 63, sheets P including the second sheet and thereafter are lifted up, resulting in a fear of occurrence of multiple-sheet feeding.

The sheet with 45 kg mentioned here is a sheet wherein a size is a 4×6 size (1091 mm in the longitudinal and 788 mm in the lateral direction) and a weight of 1000 sheets is 45 kg. When the air intake 41*b* is made to be in the state of overall shielding, there is a phenomenon that is caused when air coming from the first air blowing section 40 is intercepted, and only air coming from the second air blowing section 50 is blown against a small and thin sheet. For this problem, the inventors of the invention found out that excellent sheet feeding that is free from raising of sheets P for the second sheet and thereafter can be carried out, by making the air intake 41*b* to be in the state of partial shielding explained in the first-third shielding mechanisms without making the air intake 41*b* to be in the state of overall shielding, after sheet P1 is stuck to adsorption belt 63.

Further, in the case where sheet P is in a large size (for example, a sheet having a size of B4 or more) and is thin, if the air intake 41*b* is made to be in the state of partial shielding and gentle air is blown continuously after the first sheet P1 is stuck to adsorption belt 63, there is a fear that sheets P including the second sheet and thereafter are lifted up and multiple-sheet feeding is caused. In this case, therefore, the air intake 41*b* needs to be in the state of overall shielding. As explained above, it is necessary to change an air flow quantity of air to be blown against sheet P, depending on a size (including a thickness) of sheet P.

FIG. 12 is a graph showing the state of shielding of air intake 41*b* for the sheet wherein sheet P has a normal size (not less than B5 size and not more than A4 size) and a normal thickness (for example, sheet with 55 kg) for sheet P.

In FIG. 12, an axis of ordinate represents an air flow quantity, an axis of abscissa represents a period of time, and a left portion of the graph in FIG. 12 shows the state of blowing strong air flow against the side of an upper layer of a sheet bundle after making the air intake 41*b* to be in the state of opening. A central portion of the graph shows the state wherein the air intake 41*b* is made to be in the state of overall shielding when the first sheet P1 is stuck to adsorption belt 63, and an air flow against the side portion of the sheet bundle is made to be in the state of no air flow. A right side portion of the graph shows the state wherein the air intake 41*b* is made suddenly to be in the state of opening immediately after the first sheet P1 is detected by feed sensor PS2, and sudden air flow is blown against the side portion of the upper layer of the sheet bundle. When the side portion of the upper layer of the sheet bundle is blown by the sudden air flow, sheets in the upper layer of the sheet bundle can be lifted up surely. Further, even when the sheet P is large in size and is thin, it is preferable to use the shielding mechanism established to be in the state of shielding shown in FIG. 12.

FIG. 13 is a graph showing the state of shielding of air intake 41*b* for the sheet representing sheet P that is small in size and is thin in thickness, relating to the invention. A left portion of the graph in FIG. 13 shows the state of blowing strong air flow against the side of an upper layer of a sheet bundle after making the air intake 41*b* to be in the state of opening, similarly to FIG. 12. A central portion of the graph shows the state wherein the air intake 41*b* is made to be in the state of partial shielding when the first sheet P1 is stuck to adsorption belt 63, and an air flow against the side portion of the sheet bundle is made to be a weak air flow. A right side portion of the graph shows the state wherein the air intake 41*b* is made to be in the state of opening in the same way as the state of shielding explained in FIG. 12 immediately after the first sheet P1 is detected by feed sensor PS2, and sudden air flow is blown against the side portion of the upper layer of the sheet bundle. When the side portion of the upper layer of the sheet bundle is blown by the sudden air flow, sheets in the upper layer of the sheet bundle can be lifted up surely.

The sheet feeding device having the structure relating to the invention makes it possible to change easily an air flow quantity to be blown against sheet P depending on a size (including a thickness) of sheet P, which makes it possible to feed sheets stably, independently of sheet types.

Meanwhile, though the shielding member and the shielding state switching section both relating to the invention are provided on the side where air intake 41*b* side of the first air blowing section 40, in the present embodiment, they can also be provided inside of side portion regulating member 41, or in the vicinity of air-blowing outlet 41*a*.

Further, as the sheet feeding device of the invention, large capacity sheet feeding device LT connected to image forming apparatus main body A has been explained. However, the invention can be applied also to sheet feed cassette 10 arranged inside image forming apparatus main body A.

The aforesaid objectives of the invention can be attained by the following configurations of embodiments.

Item 1:

A sheet feeding device including: a sheet feeding tray on which a sheet bundle including a plurality of sheets is stacked; a first air blowing section which blows air in a perpendicular direction to a sheet conveyance direction against a lateral side of the sheet bundle stacked on the sheet feeding tray; a second air blowing section which blows air against a leading edge of the sheet bundle in a sheet conveyance direction from a downstream side in the sheet conveyance direction, a sheet adsorption conveyance section which adsorbs by air suction and conveys sheets one by one from an uppermost sheet of the sheet bundle; a sheet type information transmission section which transmits type information of the sheet to be used; a shielding member which is arranged to be capable of opening and closing in a ventilating path of the first air blowing section to open or shield the ventilating path; a shielding state switching section which switches a shielding state of the ventilating path by the shielding member to any one state of opening, partial shielding and overall shielding, wherein in the partial shielding state, less amount of air is allowed to pass than the amount of air in the opening state, and the air is totally shielded in the overall shielding state; a sheet adsorption detecting section which detects that the uppermost sheet in the sheet bundle has been adsorbed, and transmits detection information to the sheet adsorption conveyance section, and a control section which controls the shielding member and the shielding state switching section to operate and switch among the state of opening, partial shielding and overall shielding of the ventilating path, in accordance with the information from the sheet type information transmission section and the sheet adsorption detecting section.

Item 2:

The sheet feeding device of Item 1, further including a sheet ejection detecting section which detects that the sheet adsorbed by the sheet adsorption conveyance section is ejected, and transmits the information of detection, wherein the control section controls the shielding member and the shielding state switching section to operate and switch among the state of opening, partial shielding and overall shielding of the ventilating path, in accordance with the information from the sheet type information transmission section and one of the information from the sheet adsorption detecting section or the sheet ejection detecting section.

Item 3:

The sheet feeding device of Item 1 or 2, wherein the shielding member is urged in a direction to shield the ventilating path, and the shielding state switching section comprises a movable stopper member which contacts the shielding member, the stopper member having a first contact portion, a second contact portion and a non-contact portion, wherein the stopper is configured to move positions of the first, second and non-contact portions against the shielding member, such that: the ventilating path is in the state of opening when the first contact portion is at the position of contacting the shielding member; the ventilating path is in the state of partial shielding where the ventilating path is narrower than that in the state of opening when the second contact portion is at the position of contacting the shielding member; and the shielding member is separated from the non-contact portion and the ventilating path is in the state of overall shielding when the non-contact portion is at the position of facing to the shielding member, wherein, the control section controls the stopper member to operate and switch among the state of opening, partial shielding and overall shielding of the ventilating path, in accordance with the information from the sheet type information transmission section and the sheet adsorption detecting section.

Item 4:

The sheet feeding device of Item 1 or 2, wherein the shielding member comprises a shielding section that makes the ventilating path to be in the state of overall shielding, and a partial shielding section that makes the ventilating path to be in the state of partial shielding, and the shielding member being capable of sliding to open and close the ventilating path, wherein the shielding state switching section comprises a shielding member drive section which drives to slide the shielding member, wherein control section operates the shielding member through the shielding member drive section to switch among the state of opening, partial shielding and overall shielding of the ventilating path, in accordance with the information coming from the sheet type information transmission section and the sheet adsorption detecting section.

Item 5:

The sheet feeding device of Item 1 or 2, wherein the shielding member is urged in a direction to shield the ventilating path, and has a first partial opening section that makes the ventilating path to be in the state of partial shielding in a case of shielding, wherein the shielding state switching section comprises a movable stopper member that contacts with the shielding member; an auxiliary shielding member arranged to be capable of sliding between a first position and a second position with respect to the shielding member; and an auxiliary shielding member drive section that drives the auxiliary shielding member, wherein the auxiliary shielding member has a second partial opening section, and the stopper member has a contact portion and a non-contact portion, wherein when the contact portion of the stopper member is at the position of contacting the shielding member the ventilating path is made to be in the open state; when the non-contact portion of the stopper member is at the position facing the shielding member, and the second partial opening section of the auxiliary shielding member is at the first position where the second partial opening section agrees in phase with the first partial opening section, the ventilating path is made to be in the partial shielding state; and when the non-contact portion of the stopper member is at the position facing the shielding member, and the second partial opening section of the auxiliary shielding member is at the second position where the second partial opening section is deviated in phase from the first partial opening section, the ventilating path is made to be in the state of overall shielding, wherein the control section controls the shielding member, the stopper member and the auxiliary shielding member to operate and switch among the state of opening, partial shielding and overall shielding of the ventilating path, in accordance with the information coming from the sheet type information transmission section and the sheet adsorption detecting section.

Item 6:

The sheet feeding device of any one of Items 1 to 5, wherein the sheet type information comprises information of a longitudinal size, a lateral size and a thickness of the sheet.

Item 7:

An image forming apparatus including: an image forming section for forming an image on an image carrier; a transfer section that transfers an image on the image carrier onto a sheet; and a sheet feeding device which includes: a sheet feeding tray on which a sheet bundle including a plurality of sheets is stacked; a first air blowing section which blows air in a perpendicular direction to a sheet conveyance direction against a lateral side of the sheet bundle stacked on the sheet feeding tray; a second air blowing section which blows air against a leading edge of the sheet bundle in a sheet conveyance direction from a downstream side in the sheet conveyance direction, a sheet adsorption conveyance section which adsorbs by air suction and conveys sheets one by one from an uppermost sheet of the sheet bundle; a sheet type information transmission section which transmits type information of the sheet to be used; a shielding member which is arranged to be capable of opening and closing in a ventilating path of the first air blowing section to open or shield the ventilating path; a shielding state switching section which switches a shielding state of the ventilating path by the shielding member to any one state of opening, partial shielding and overall shielding, wherein in the partial shielding state, less amount of air is allowed to pass than the amount of air in the opening state, and the air is totally shielded in the overall shielding state; a sheet adsorption detecting section which detects that the uppermost sheet in the sheet bundle has been adsorbed, and transmits detection information to the sheet adsorption conveyance section, and a control section which controls the shielding member and the shielding state switching section to operate and switch among the state of opening, partial shielding and overall shielding of the ventilating path, in accordance with the information from the sheet type information transmission section and the sheet adsorption detecting section, wherein a transfer section transfers the image on the image carrier onto the sheet conveyed from the sheet feeding device.

By the use of the sheet feeding device having the structure in the invention, it is possible to offer a sheet feeding device that is free from the problem of multiple-sheet feeding even for sheets having various sizes (including thicknesses), especially for sheets which are small in size and thin in thickness, and has stable quality.

What is claimed is:

1. A sheet feeding device comprising:

a sheet feeding tray on which a sheet bundle including a plurality of sheets is stacked;

a first air blowing section which blows air in a perpendicular direction to a sheet conveyance direction against a lateral side of the sheet bundle stacked on the sheet feeding tray;

a second air blowing section which blows air against a leading edge of the sheet bundle in a sheet conveyance direction from a downstream side in the sheet conveyance direction, a sheet adsorption conveyance section which adsorbs by air suction and conveys sheets one by one from an uppermost sheet of the sheet bundle;

a sheet type information transmission section which transmits a sheet type information of the sheet to be used;

a shielding member which is arranged to be capable of opening and closing in a ventilating path of the first air blowing section to open or shield the ventilating path;

a shielding state switching section which switches a shielding state of the ventilating path by the shielding member to any one state of opening, partial shielding and overall shielding, wherein in the partial shielding state, less amount of air is allowed to pass than an amount of air in the opening state, and the air is totally shielded in the overall shielding state;

a sheet adsorption detecting section which detects that the uppermost sheet in the sheet bundle has been adsorbed, and transmits detection information to the sheet adsorption conveyance section; and a control section which controls the shielding member and the shielding state switching section to operate and switch among the state of opening, partial shielding and overall shielding of the ventilating path, in accordance with the sheet type information from the sheet type information transmission section and the sheet adsorption detecting section;

wherein in cases where the sheet adsorption detecting section detects that the sheet is adsorbed by the sheet adsorption conveyance section, the control section controls the movement of the shielding state switching section such that in cases where a size of the sheet is less than a prescribed size, to make the partial shielding of the ventilating path for blowing a small amount of the air; and in cases where the size of the sheet is not less than the prescribed size, to make the overall shielding of the ventilating path for not blowing air.

2. The sheet feeding device of claim 1, further comprising a sheet ejection detecting section which detects that the sheet adsorbed by the sheet adsorption conveyance section is ejected, and transmits the information of detection, wherein the control section controls the shielding member and the shielding state switching section such that:

in cases where a size of the sheet is less than a prescribed size, to make the partial shielding of the ventilating path for blowing a small amount of the air;

in cases where the size of the sheet is not less than the prescribed size, to make the overall shielding of the ventilating path for not blowing air; and in cases where the sheet ejection detecting section detects the sheet being ejected, to make a shielding state of the ventilating path in the state of opening.

3. The sheet feeding device of claim 1, wherein the shielding member is urged in a direction to shield the ventilating path, and the shielding state switching section comprises a movable stopper member configured with a rotatable cam which contacts the shielding member, the stopper member having a first contact portion, a second contact portion and a non-contact portion, wherein the stopper member is configured to allow each of the first portion, the second portion and the non-contact portion to face the shielding member, such that:

the ventilating path is in the state of opening when the first contact portion is at the position of contacting the shielding member;

the ventilating path is in the state of partial shielding where the ventilating path is narrower than that in the state of opening when the second contact portion is at the position of contacting the shielding member; and the shielding member is separated from the non-contact portion and the ventilating path is in the state of overall shielding when the non-contact portion is at the position of facing to the shielding member, wherein, the control section controls the stopper member to operate and switch among the state of opening, partial shielding and overall shielding of the ventilating path, in accordance with sheet size information from the sheet type information transmission section and information from the sheet adsorption detecting section.

4. The sheet feeding device of claim 1, wherein the shielding member comprises a shielding section that makes the ventilating path to be in the state of overall shielding, and a partial shielding section that makes the ventilating path to be in the state of partial shielding, and the shielding member being capable of sliding to open and close the ventilating path, wherein the shielding state switching section comprises a shielding member drive section which drives to slide the shielding member, wherein control section operates the shielding member through the shielding member drive section to switch among the state of opening, partial shielding and overall shielding of the ventilating path, in accordance with the information coming from the sheet type information transmission section and the sheet adsorption detecting section.

5. The sheet feeding device of claim 1, wherein the shielding member is urged in a direction to shield the ventilating path, and has a first partial opening section that makes the ventilating path to be in the state of partial shielding in a case of shielding, wherein the shielding state switching section comprises a movable stopper member that contacts with the shielding member; an auxiliary shielding member arranged to be capable of sliding between a first position and a second position with respect to the shielding member; and an auxiliary shielding member drive section that drives the auxiliary shielding member, wherein the auxiliary shielding member has a second partial opening section, and the stopper member has a contact portion and a non-contact portion, wherein when the contact portion of the stopper member is at the position of contacting the shielding member the ventilating path is made to be in the open state; when the non-contact portion of the stopper member is at the position facing the shielding member, and the second partial opening section of the auxiliary shielding member is at the first position where the second partial opening section agrees in phase with the first partial opening section, the ventilating path is made to be in the partial shielding state; and when the non-contact portion of the stopper member is at the position facing the shielding member, and the second partial opening section of the auxiliary shielding member is at the second position where the second partial opening section is deviated in phase from the first partial opening section, the ventilating path is made to be in the state of overall shielding, wherein the control section controls the shielding member, the stopper member and the auxiliary shielding member to operate and switch among the state of opening, partial shielding and overall shielding of the ventilating path, in accordance with the information coming from the sheet type information transmission section and the sheet adsorption detecting section.

6. The sheet feeding device of claim 1, wherein the sheet type information comprises information of a longitudinal size, a lateral size and a thickness of the sheet.

7. An image forming apparatus comprising:

an image forming section for forming an image on an image carrier;

a transfer section that transfers an image on the image carrier onto a sheet; and a sheet feeding device comprising:

a sheet feeding tray on which a sheet bundle including a plurality of sheets is stacked;

a first air blowing section which blows air in a perpendicular direction to a sheet conveyance direction against a lateral side of the sheet bundle stacked on the sheet feeding tray;

a second air blowing section which blows air against a leading edge of the sheet bundle in a sheet conveyance direction from a downstream side in the sheet conveyance direction, a sheet adsorption conveyance section which adsorbs by air suction and conveys sheets one by one from an uppermost sheet of the sheet bundle;

a sheet type information transmission section which transmits a sheet type information of the sheet to be used;

a shielding member which is arranged to be capable of opening and closing in a ventilating path of the first air blowing section to open or shield the ventilating path;

a shielding state switching section which switches a shielding state of the ventilating path by the shielding member to any one state of opening, partial shielding and overall shielding, wherein in the partial shielding state, less amount of air is allowed to pass than the amount of air in the opening state, and the air is totally shielded in the overall shielding state;

a sheet adsorption detecting section which detects that the uppermost sheet in the sheet bundle has been adsorbed, and transmits detection information to the sheet adsorption conveyance section, and a control section which controls the shielding member and the shielding state switching section to operate and switch among the state of opening, partial shielding and overall shielding of the ventilating path, in accordance with the sheet type information from the sheet type information transmission section and information from the sheet adsorption detecting section, wherein a transfer section transfers the image on the image carrier onto the sheet conveyed from the sheet feeding device, and wherein in cases where the sheet adsorption detecting section detects that the sheet is adsorbed by the sheet adsorption conveyance section, the control section controls the movement of the shielding state switching section such that in cases where a size of the sheet is less than a prescribed size, to make the partial shielding of the ventilating path for blowing a small amount of the air; and in cases where the size of the sheet is not less than the prescribed size, to make the overall shielding of the ventilating path for not blowing air.

8. The image forming apparatus of claim 7, wherein the sheet feeding device further comprises a sheet ejection detecting section which detects that the sheet adsorbed by the sheet adsorption conveyance section is ejected, and transmits the information of detection, wherein the control section controls the shielding member and the shielding state switching section such that:

in cases where a size of the sheet is less than a prescribed size, to make the partial shielding of the ventilating path for blowing a small amount of the air;

in cases where the size of the sheet is not less than the prescribed size, to make the overall shielding of the ventilating path for not blowing air; and in cases where the sheet ejection detecting section detects the sheet being ejected, to make a shielding state of the ventilating path in the state of opening.

9. The image forming apparatus of claim 7, wherein the shielding member arranged to be capable of opening and closing is urged in a direction to shield the ventilating path, and the shielding state switching section comprises a movable stopper member configured with a rotatable cam which contacts the shielding member, the stopper member having a first contact portion, a second contact portion and a non-contact portion, wherein the stopper member is configured to allow each of the first portion, the second portion and the non-contact portion to face the shielding member, such that:

the ventilating path is in the state of opening when the first contact portion is at the position of contacting the shielding member;

the ventilating path is in the state of partial shielding where the ventilating path is narrower than that in the state of opening when the second contact portion is at the position of contacting the shielding member; and the shielding member is separated from the non-contact portion and the ventilating path is in the state of overall shielding when the non-contact portion is at the position of facing to the shielding member, wherein, the control section controls the stopper member to operate and switch among the state of opening, partial shielding and overall shielding of the ventilating path, in accordance with the information from the sheet type information transmission section and the sheet adsorption detecting section.

10. The image forming apparatus of claim 7, wherein the shielding member comprises a shielding section that makes the ventilating path to be in the state of overall shielding, and a partial shielding section that makes the ventilating path to be in the state of partial shielding, and the shielding member being capable of sliding to open and close the ventilating path, wherein the shielding state switching section comprises a shielding member drive section which drives to slide the shielding member, wherein control section operates the shielding member through the shielding member drive section to switch among the state of opening, partial shielding and overall shielding of the ventilating path, in accordance with the information coming from the sheet type information transmission section and the sheet adsorption detecting section.

11. The image forming apparatus of claim 7, wherein the shielding member is urged in a direction to shield the ventilating path, and has a first partial opening section that makes the ventilating path to be in the state of partial shielding in a case of shielding, wherein the shielding state switching section comprises a movable stopper member that contacts with the shielding member; an auxiliary shielding member arranged to be capable of sliding between a first position and a second position with respect to the shielding member; and an auxiliary shielding member drive section that drives the auxiliary shielding member, wherein the auxiliary shielding member has a second partial opening section, and the stopper member has a contact portion and a non-contact portion, wherein when the contact portion of the stopper member is at the position of contacting the shielding member the ventilating path is made to be in the open state; when the non-contact portion of the stopper member is at the position facing the shielding member, and the second partial opening section of the auxiliary shielding member is at the first position where the second partial opening section agrees in phase with the first partial opening section, the ventilating path is made to be in the partial shielding state; and when the non-contact portion of the stopper member is at the position facing the shielding member, and the second partial opening section of the auxiliary shielding member is at the second position where the second partial opening section is deviated in phase from the first partial opening section, the ventilating path is made to be in the state of overall shielding, wherein the control section controls the shielding member, the stopper member and the auxiliary shielding member to operate and switch among the state of opening, partial shielding and overall shielding of the ventilating path, in accordance with the information coming from the sheet type information transmission section and the sheet adsorption detecting section.

12. The image forming apparatus of claim 7, wherein the sheet type information comprises information of a longitudinal size, a lateral size and a thickness of the sheet.

* * * * *